United States Patent [19]

Keck et al.

[11] 4,080,596

[45] Mar. 21, 1978

[54] BINGO GAME INDICATOR

[76] Inventors: Rogers R. Keck, 66 Arago; Ernest L. Viola, 1711 San Jose Ave., both of San Francisco, Calif. 94112

[21] Appl. No.: 654,372

[22] Filed: Feb. 2, 1976

[51] Int. Cl.[2] ..... G08B 23/00

[52] U.S. Cl. ..... 340/323 R; 340/337

[58] Field of Search ..... 340/323, 337; 340/323 R

[56] References Cited

U.S. PATENT DOCUMENTS

| | | | |
|---|---|---|---|
| 1,235,005 | 7/1917 | Brown | 340/337 |
| 2,146,576 | 2/1939 | Haselton | 340/337 |
| 2,203,630 | 6/1940 | Keen | 340/337 |
| 2,562,179 | 7/1951 | Dorf | 340/323 |

*Primary Examiner*—Thomas B. Habecker
*Attorney, Agent, or Firm*—Alfons Puishes

[57] ABSTRACT

A lighted display board or sign has a viewing face subdivided into 25 squares arranged five by five simulating a Bingo playing card and having a separate light positioned behind each square. An unusual circuit and switching arrangement makes it possible by merely closing a single switch to cause the lights on the board to indicate to the players what particular design, such as an "X", cross, square, etc., must be attained to obtain a "Bingo" or winner for the particular game then in progress. An on and off flashing light spelling out the words Bingo forms a part of the basic circuit.

2 Claims, 11 Drawing Figures

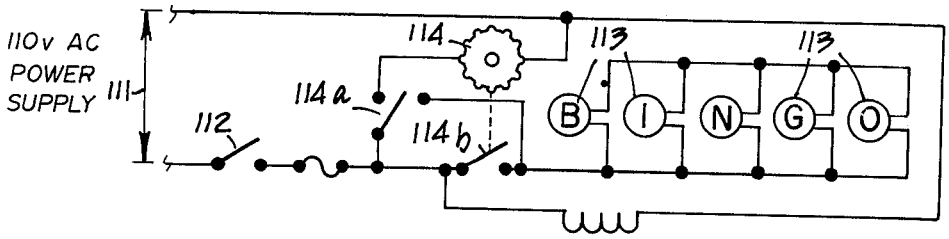
FIG. 1.
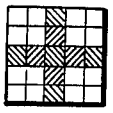
FIG. 1A.
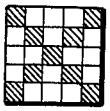
FIG. 1B.
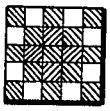
FIG. 1C.
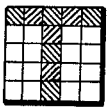
FIG. 1D.
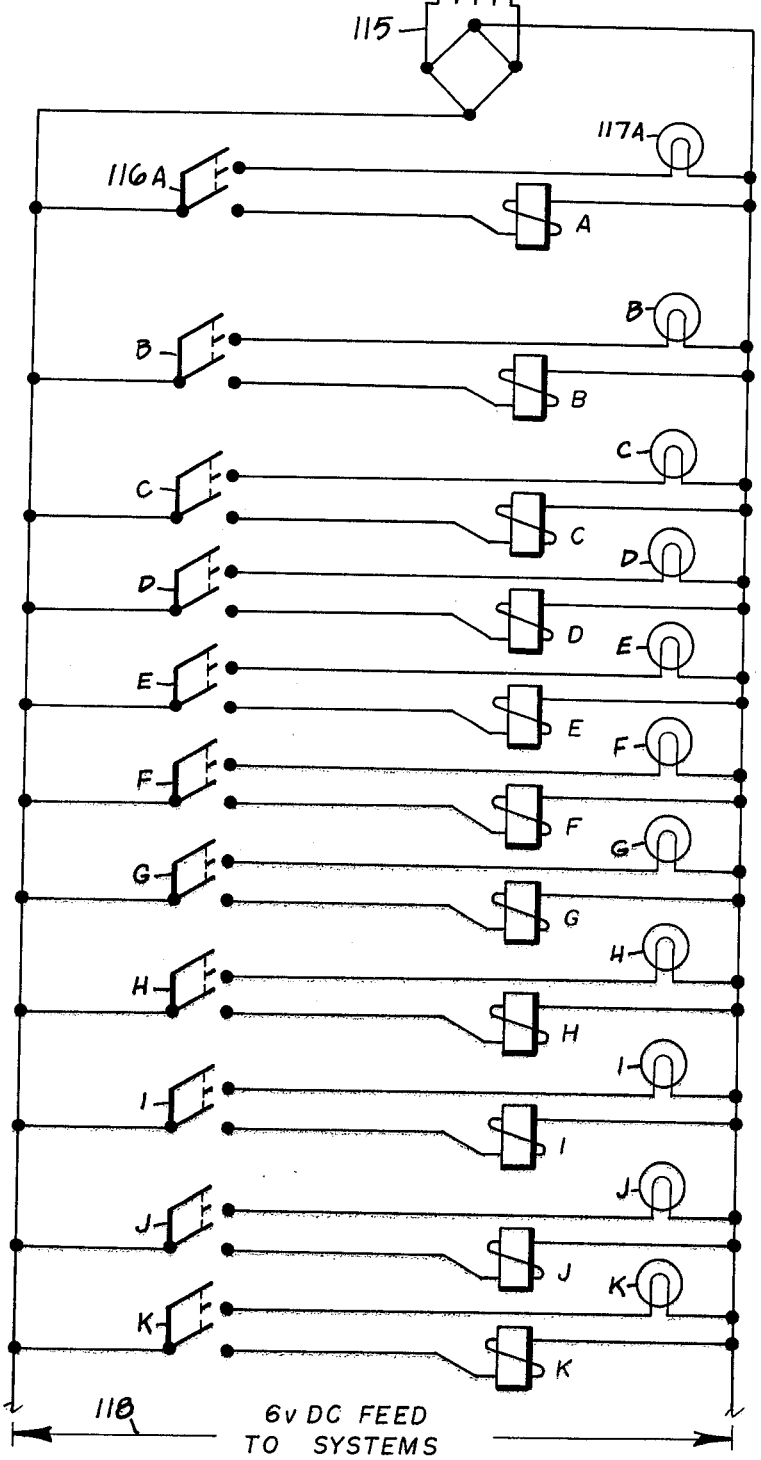

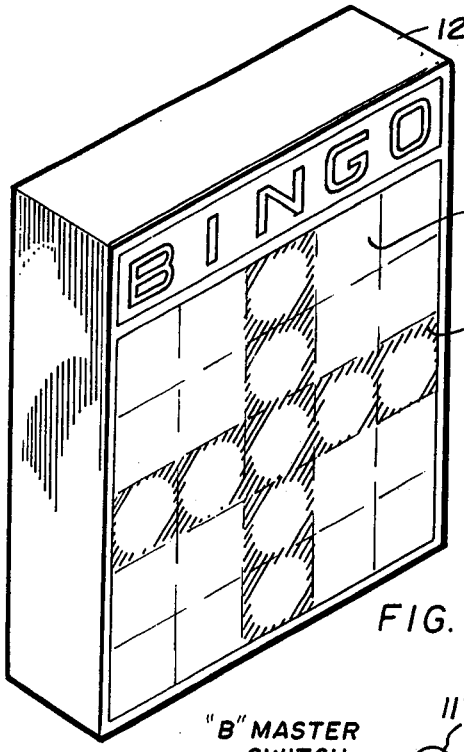
FIG. 7.
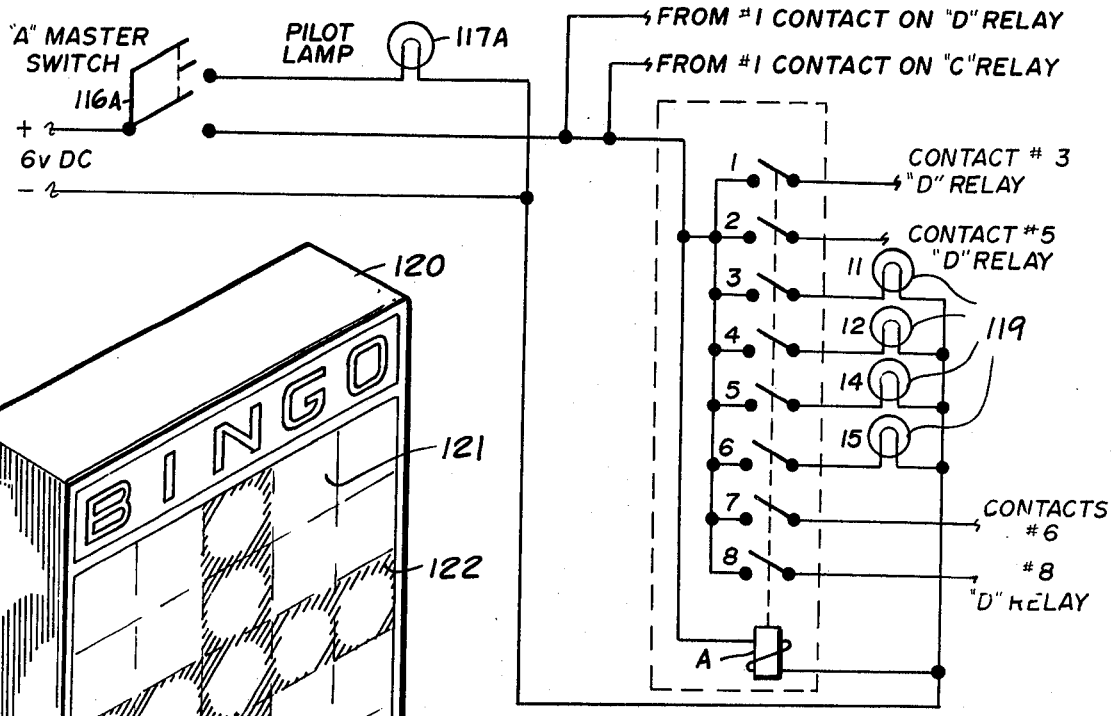
FIG. 2.
SYSTEM "A" RELAY
6v DC RELAY
8 NORMALLY OPEN CONTACTS
FORMS FIG. 1A
FIG. 3.
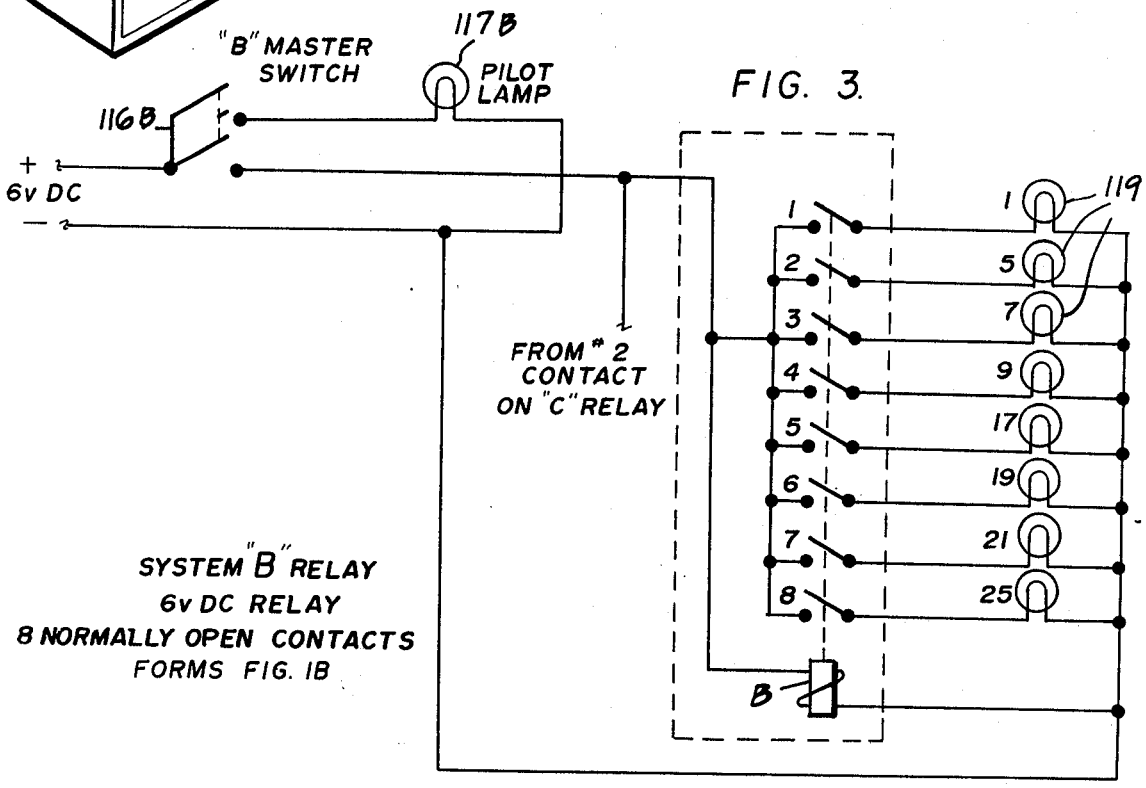
SYSTEM "B" RELAY
6v DC RELAY
8 NORMALLY OPEN CONTACTS
FORMS FIG. 1B

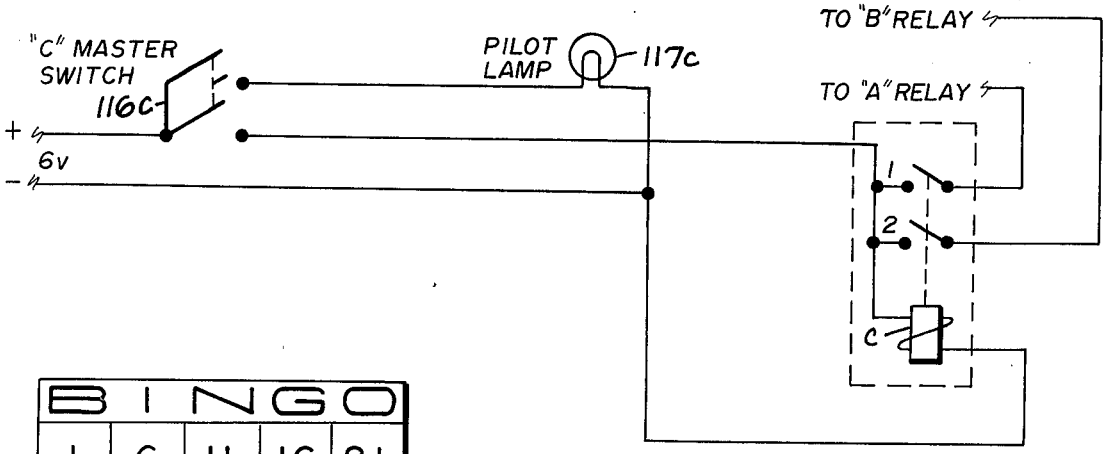
FIG. 4.
SYSTEM "C" RELAY
6v DC RELAY
2 NORMALLY OPEN CONTACTS
FORMS FIG. IC
| B | I | N | G | O |
|---|---|---|---|---|
| 1 | 6 | 11 | 16 | 21 |
| 2 | 7 | 12 | 17 | 22 |
| 3 | 8 | 13 | 18 | 23 |
| 4 | 9 | 14 | 19 | 24 |
| 5 | 10 | 15 | 20 | 25 |
119
FIG. 6.
SYSTEM "D" RELAY
6v DC RELAY
5 NORMALLY OPEN, 4 NORMALLY CLOSED CONTACTS
FIG. 5.
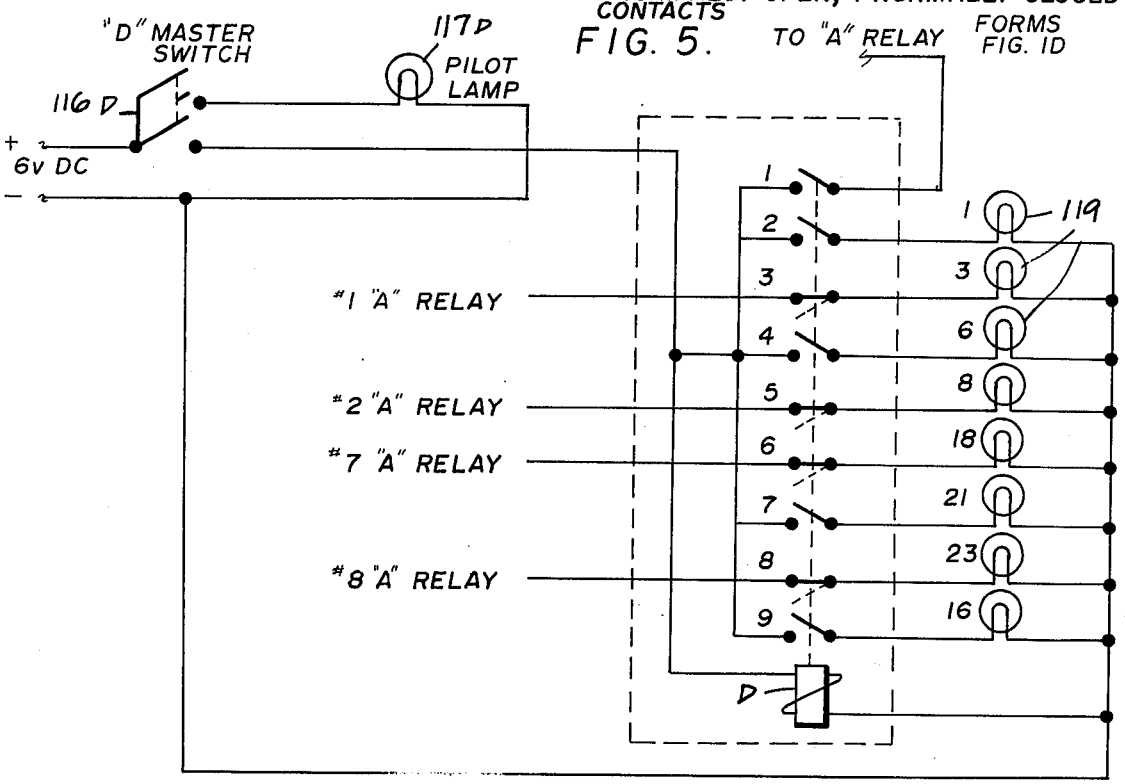

BINGO GAME INDICATOR

BACKGROUND OF THE INVENTION

The popular game of Bingo wherein a group of players place indicators at specific locations on a graduated board in response to orders called out by the game operator until a predetermined pattern is formed, whereupon the first to form said pattern is the winner, has been well known for many years. Numerous devices have been made and used to facilitate the playing of this game, particularly in large groups at church organizations, clubs and parties. These have taken the form of electrically lighted and actuated devices in some cases to actually play the game itself and in other to merely assist in the game. The prior art as presently known to the applicant is set forth briefly below.

Peak, U.S. Pat. No. 2,760,619. Peak is, among other things, an apparatus comprising an electrical panel on which are positioned the 25 lights corresponding to a Bingo board, each light being actuated by a separate switch as the numbers and letters are called out so that the electrically lighted board itself takes the place of the conventional Bingo board and the overall device actually comprises a game in itself.

Hofsetz, U.S. Pat. No. 2,594,434 teaches a device which automatically mixes and delivers in succession balls containing the Bingo letter and number to the person running the game who in turn calls it out for the players to position upon their board as the game progresses.

Taylor, U.S. Pat. No. 3,671,040 teaches a very sophisticated and highly automatized, coin operated Bingo game and also provides what amounts to a complete method of playing the game.

Pawelka, U.S. Pat. No. 3,271,529 teaches a game board equipped with electrical switching devices which in combination with the other elements disclosed makes possible an automatic, or at least a semi-automatic, method of playing the game.

Goloborodko, U.S. Pat. No. 2,333,002 teaches light display boards wherein the numbered lights are actuated by a rotating switch which in turn is operated in the manner of any other gambling wheel but causes the lights to show on the display boards for the benefit of the players.

As is evident from the above brief summaries that all of this art is concerned with a game itself, or a method of playing a game such as Bingo. None of the devices known to applicant are designed or constructed as an aid or guide to a Bingo game played in the usual manner with ordinary Bingo playing equipment.

It is also evident that electrical lighting equipment may be used to display Bingo designs to players by actuating a large number of switches to correspond with the lights it is desired to illuminate in accordance with the design for the particular game being played. Such a procedure however, is complicated and cumbersome and offers no advantage to the person operating the game.

SUMMARY OF THE INVENTION

We have invented a circuitry and switching arrangement which eliminates the objections and particularly the cumbersomeness of present methods used to conduct a Bingo game. Our invention makes possible the illumination of an electrically lighted display board to correspond with the design or plan of any game it is desired to play.

By properly interconnecting our circuits and utilizing strategically placed relays in a unique manner, we are able to display on our board any desired design by merely closing a single switch. When a given game is completed by someone attaining a Bingo and after that is verified, all we need do is open the switch for that particular game and close any one of a number of other switches and our board automatically lights up to show what the design or pattern is for the next game. Thus by means of our invention we are able to have one switch take the place of what would be at least 25 switches if each light were separately actuated.

In addition to the convenience which we provide, we eliminate also the source of human error and consequent difficulties which might arise.

We have found that the use of our device greatly enhances the playing of the game, not only on the part of the operators but on the part of the players themselves who seem to derive considerable satisfaction in having the designs or patterns flashed to them in this rapid and concise manner.

As a part of our basic circuitry, we may include also lighting and switching arrangements which intermittently flash the word "Bingo" on and off after a Bingo has been attained by one of the players.

DESCRIPTION OF THE DRAWINGS

FIG. 1 is a master wiring diagram showing the basic circuitry of our invention.

FIGS. 1*a* through 1*d* show typical various designs of patterns used on cards in Bingo games which may be displayed by our invention for the conduct of each game shown.

FIG. 2 is a wiring diagram showing the circuitry of system "A" which produces the pattern of FIG. 1*a*.

FIG. 3 is a wiring diagram showing the circuitry of system "B" which produces the pattern of FIG. 1*b*.

FIG. 4 is a wiring diagram showing the circuitry of system "C" which produces the pattern of FIG. 1*c*.

FIG. 5 is a wiring diagram showing the circuitry of system "D" which produces the pattern of FIG. 1*d*.

FIG. 6 is a diagrammatic representation of the front of our indicator showing the location of the signal lights positioned behind the display board screen which correspond to the numbers shown for the lights in FIGS. 2 through 5.

FIG.7 is an isometric view showing the appearance of our device when assembled.

DESCRIPTION OF A PREFERRED EMBODIMENT

Referring first to FIG. 1, there is seen a source of power supply 111 indicated schematically which may be a conventional 110 volt AC source. The main connects with switch 112 which may be of a single pole, single throw type and also controls the power input to lights 113 which together spell out the word Bingo. These lights may be made to flash on and off by operating an interrupting make and break switch 114 to which power may be supplied through switch 114*a* or cut off by the same switch which is of a double throw type. The interruptions or blinking of the Bingo lights is effected by switch 114*b* operated from the actuator 114.

When using a 110 volt AC supply as shown, we employ a combined transformer-rectifier 115 which converts the power supply to the various systems to 6 volt DC which we have found to be more convenient, although this is not essential to the successful operating of our invention.

We next employ a series of master switches shown at 116A through K which feed are individual systems labeled "A" through "K" which are arranged and wired to produce the designs or patterns shown on FIGS. 1A through 1D as set forth more fully below.

The relays "A" through "K" and pilot lamps 117A through K are connected as shown and their positions and functions are more clearly shown in FIGS. 2 through 5 to which reference should now be had.

While our invention is adapted to produce any desired design or pattern, we have shown in detail only four of the better known ones, the principles of our invention being the same when used to produce other well known patterns.

In FIGS. 2 through 5 the position and connections of relays "A" through "D" are seen and their contacts numbered 1 through 9 are shown. These contacts sometimes perform the function of closing the circuit to the signal lights identified collectively as 119 but individually numbered as 1 through 25 to take care of the 25 numbers on a conventional Bingo board. At other times these contacts perform the function of closing the circuits to other systems for combining patterns to produce other patterns as desired and as further set forth below.

The position of the lights 119 with respect to the indicator assembly are shown on FIG. 6 where each of the numbers correspond to a light number shown on the FIGS. 2 through 5.

The five by five light arrangement of the 25 lights positioned as shown in FIG. 6 is positioned inside of our indicator housing or assembly shown on FIG. 7. Here the housing itself 120 has positioned on its viewing surface, a translucent screen 122 behind which are situated the lighting arrangement of FIG. 6, each light occupying a position within one of the squares 121.

As indicated on the drawings, FIG. 2 comprises the arrangement used to produce FIG. 1A and is known as system A. The relay A operates to close the 8 normally opened contacts 1 through 8. Contacts 3, 4, 5, and 6 operate to supply current and thereby illuminate lights 11, 12, 14 and 15. Contacts 1, 2, 7 and 8 serve to supply current through contacts 3, 5, 6 and 8 of FIG. 5 which are normally closed and thus supply current to lights 3, 8, 18 and 23. The wiring to light number 13 is not shown since this remains lighted at all times and is what is known in a Bingo game as a "free" number. It is now evident that by closing switch 116A and thus actuating relay A there is caused to be displayed on the indicator screen 122 the cross of FIG. 1A.

If now switch 116A is opened and switch 116B is closed we obtain the condition seen on FIG. 3 or system B. Here the relay B operates to close the 8 normally opened contacts 1 through 8 which illuminate the lights 1, 5, 7, 9, 17, 19, 21 and 25 as shown, thereby forming the X-pattern of FIG. 1B.

When it is desired to produce the pattern shown in FIG. 1C, which is basically a combination of patterns 1A and 1B, it is necessary only to open switch 116B and close switch 116C, bringing into play the system C of FIG. 4. Here the two normally open contacts 1 and 2 of FIG. 4 are closed by relay C which then energize both relays A and B and effect the combined pattern of FIG. 1C.

When it is desired to produce the pattern of FIG. 1D which is essentially a "T", the switch 116D is closed, the other master switches remaining open. This brings into effect the condition of FIG. 5 or system D. Here the relay D operates to close normally opened contacts 1, 2, 4, 7 and 9 and open normally closed contacts 3, 5, 6 and 8. Contacts 2, 4, 7 and 9 serve to supply current to lights 1, 6, 16 and 21. Contact 1 serves to energize relay A of FIG. 2, closing all contacts previously used to form the cross. Since lights 3, 8, 18 and 23 are now not needed to form the "T", the normally closed contacts controlling these lights previously energized from relay A are open, thus leaving only the lights necessary to form the "T", namely 1, 6, 11, 16, 21, 12, 14 and 15 plus, of course, the free light 13.

It should be evident now that by thus interconnecting our control relays with the needed 25 lights, we are able to obtain any conventional Bingo board pattern such as an open square, four outside corners, an inside square, etc. Using our arrangement it is necessary only to have the actuating relay or control relay of any one given system interconnected with the circuitry of another system in such a manner as to supply current to the lights it is desired to illuminate to indicate the game pattern desired and cut off the current from those lights which are not needed.

We claim:

1. A bingo game indicator comprising:

an electrical power supply connecting to a master circuit and to a plurality of secondary circuits in parallel therewith;

said master circuit comprising a plurality of parallel branches, and each of said secondary circuits comprising a plurality of parallel branches;

a solenoid coil connected in series with a switch in each of said parallel branches in said master circuit;

a relay switch connected in series with a light in each of said parallel branches in said secondary circuits;

each of said solenoid coils in said master circuit being disposed to simultaneously open or close a predetermined number of said relay switches in one of said secondary circuits;

said electric lights in each of said branches in said secondary circuits being positioned in predetermined locations upon a single display screen;

means for opening and closing said switches in each of said parallel branches in said master circuit;

thereby energizing said solenoid coils to operate said relay switches and illuminate said lights thus permitting the production simultaneously of a multiplicity of predetermined patterns on said single screen by the operation of a single switch for each pattern.

2. The bingo game indicator of claim 1 having a number of said parallel branches of said master circuit with a solenoid coil connected in series with a switch in each branch;

said solenoid coil being disposed to simultaneously open or close relay switches connected so as to energize the solenoid coils of other of said parallel branches;

thereby simultaneously opening or closing the relay switches of said other parallel branches;

whereby superimposed combinations of said predetermined patterns of said other branches are produced on said single screen.

* * * * *